US008076627B2

(12) United States Patent
Rosine et al.

(10) Patent No.: US 8,076,627 B2
(45) Date of Patent: Dec. 13, 2011

(54) SHAPE MEMORY ALLOY FOR MCP LOCKDOWN

(75) Inventors: Steven David Rosine, Roanoke, VA (US); Khang V. Nguyen, Salem, VA (US); Michael Scott Mills, Christiansburg, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 54 days.

(21) Appl. No.: 12/767,121

(22) Filed: Apr. 26, 2010

(65) Prior Publication Data

US 2011/0260608 A1 Oct. 27, 2011

(51) Int. Cl.
*H01J 40/14* (2006.01)
*H01J 43/00* (2006.01)

(52) U.S. Cl. ..... 250/207; 250/214 VT; 313/103 CM

(58) Field of Classification Search ..... 250/207, 250/214 VT; 313/103 CM
See application file for complete search history.

(56) References Cited

U.S. PATENT DOCUMENTS

| | | | | |
|---|---|---|---|---|
| 4,675,472 | A * | 6/1987 | Krumme et al. | 174/561 |
| 2006/0145016 | A1 * | 7/2006 | Renfro | 244/158.1 |
| 2009/0206552 | A1 * | 8/2009 | Nguy et al. | 277/306 |

* cited by examiner

*Primary Examiner* — Thanh X Luu
(74) *Attorney, Agent, or Firm* — RatnerPrestia

(57) ABSTRACT

An image intensifier tube includes a microchannel plate (MCP) having conductive input and output surfaces disposed in a housing. A conductive lower support is in electrical contact with the output surface of the MCP, and a conductive upper support is disposed above the input surface of the MCP. A shape memory alloy (SMA) lockdown is disposed between the input surface of the MCP and the upper support. The SMA lockdown is configured to provide a lockdown for the MCP in the housing. An SMA upper surface is configured to provide an axial force against the upper support, and an SMA lower surface is in contact with the input surface of the MCP.

20 Claims, 7 Drawing Sheets

SHAPE MEMORY ALLOY FOR MCP LOCKDOWN

FIELD OF THE INVENTION

The present invention relates, in general, to image intensifier tubes used in night vision goggle (NVG) devices. More specifically, the present invention relates to a shape memory alloy (SMA) for retaining a microchannel plate (MCP) at a precise location within the housing of the image intensifier tube.

BACKGROUND OF THE INVENTION

Image intensifier devices multiply the amount of incident light they receive and provide an increase in light output, which can be supplied either to a camera or directly to the eyes of a viewer. Image intensifiers are constructed for a variety of applications and hence vary in both shape and size. These devices are particularly useful for providing images from dark regions and have both industrial and military applications. For example, image intensifiers are used in night vision goggles for enhancing the night vision of aviators and other military personnel performing covert operations. They are employed in security cameras and in medical instruments to help alleviate conditions such as retinitis pigmentosis (night blindness).

As known, three major components of image intensifier tubes are the photocathode, phosphor screen (anode), and the MCP disposed between the photocathode and anode. These three components are positioned within an evacuated housing or vacuum envelope, thereby permitting electrons to flow from the photocathode through the MCP and the anode. In order for the image intensifier tube to operate, the photocathode and anode are normally coupled to an electric source, whereby the anode is maintained at a higher positive potential than the photocathode. Similarly, the MCP is biased and operates to increase the density of the electron emission set forth by the photocathode. Furthermore, since the photocathode, MCP and anode are all held at different electrical potentials, all three components are electrically isolated from one anther, when retained within the vacuum housing.

Referring to FIG. 1, there is shown a cross-sectional view of a conventional Gen III image intensifier tube 10 of the type manufactured by ITT Night Vision of Roanoke, Va. The prior art Gen III image intensifier tube 10 includes an evacuated housing 12 made from the assemblage of several separate components. Within housing 12, positioned are photocathode 14, microchannel plate (MCP) 16, and an inverting fiber optic element 18, the latter supporting phosphor screen 20. The construction for vacuum housing 12 forms an air tight envelope between photocathode 14 and fiber optic element 18.

The photocathode 14 rests upon a conductive support ring 22 at one end of vacuum housing 12. The abutment of photocathode 14 against support ring 22 creates an air tight seal, thereby closing one end of vacuum housing 12.

The lower end of vacuum housing 12 is sealed by the presence of an output screen flange 72. The output screen flange 72 is joined to fiber optic element 18 and forms an air tight envelope, thereby closing the other end of vacuum housing 12.

Between support ring 22, and screen flange 72 are additional elements providing annular spacers and electrical terminals for MCP 16 and fiber optic element 18. These elements are described in detail in U.S. Pat. No. 5,994,824, which is incorporated herein by reference in its entirety.

Completing the description of FIG. 1, an upper MCP terminal 32 extends into vacuum housing 12, where it conductively engages a metal hold down ring 36 and a contact ring 38. The contact ring 38 engages the conductive upper surface 42 of MCP 16, while the hold down ring retains the MCP within the housing. Consequently, an electrical bias may be applied to upper surface 42 of MCP 16 by applying the electrical bias to upper MCP terminal 32 on the exterior of vacuum housing 12. Similarly, a lower MCP terminal 48 extends into vacuum housing 12 and engages the lower conductive surface 44 of MCP 16. As such, the lower conductive surface 44 of MCP 16 may be coupled to ground by connecting the lower MCP terminal 48 to a ground potential external of vacuum housing 12.

Referring next to FIGS. 2 and 3, two examples are shown of how MCP 16 is fixed into position and sandwiched between an upper electrical terminal contacting upper MCP surface 42 and a lower electrical terminal contacting lower MCP surface 44. In FIG. 2, a ceramic ring 78 is positioned below support ring 22 (FIG. 1), and joined to the support ring during a brazing operation. The brazing operation creates an impervious seal between support ring 22 and ceramic ring 78. The ceramic ring 78 is part of ring assembly 86 for retaining the MCP.

The ring assembly 86 includes ceramic ring 78, conductive snap ring 77, MCP ceramic ring 46, and MCP lower support terminal 48. The ceramic ring 78 includes a first metalized surface 88 in electrical contact with conductive snap ring 77, and a second metalized surface 89 for providing electrical contact external to the housing and permit an electric source to be applied. The conductive snap ring 77 is formed of a metal or a metallic alloy. Snap ring 77 has a surface 77B conductively engaging the upper surface 42 of the MCP, and another surface 77A bonded to surface 88 of ceramic ring 78.

As illustrated, the conducting snap ring 77 is positioned between ceramic ring 78 and the MCP upper surface 42. The MCP rests against and is retained by snap ring 77 and ceramic ring 78. The MCP insulator ceramic ring 46 is positioned below and coupled to metalized surface 89 by a brazing ring (not shown) interposed between the two elements. The MCP insulator ceramic ring 46 is brazed to both metalized surface 89 and MCP lower support 48.

Thus, snap ring assembly 86 retains the MCP by using metalized ceramic 78 in combination with metalized snap ring 77 to provide both the lockdown and electrical contact. This feature eliminates the need for complex metal parts including mechanical rings and tabs used in other image intensifiers to hold the MCP in a fixed position.

In another example, as shown in FIG. 3, the MCP lower support 48 is employed to both laterally center and axially support MCP 16. The lower support structure provides a tab portion 48A, which is disposed laterally to surface 16C of the MCP, to prevent lateral dislocation of the MCP, and at the same time to maintain sufficient distance from the snap ring conductive surface in order to prevent short circuiting the device. The upper support structure 32, on the other hand, is curved downwardly toward snap ring 77 at its end portion 32A. The spring force of snap ring 77 is effective in forming a normal force against end portion 32A, so that the snap ring becomes wedged between the MCP and the upper support structure 32. In this manner, the upper surface 42 of the MCP is provided with an electrical potential by way of both the snap ring and the upper support structure. In addition, the MCP is fixed and locked down into position within the image intensifier tube.

A top view of snap ring 77 is shown in FIG. 4. In the example shown, the outer diameter 77G of the snap ring is 1.3 inches, whereas the ceramic ring 78 (FIG. 2) has an aperture with an inner diameter of 1.24 inches (for example). As a result, the snap ring includes dual cavities 77F, which are carved out of the ring's surface, for compressing the ring with the help of pliers. After compressing its outer diameter, snap ring 77 fits into the recess formed by the chamfer of metalized surface 88. In this manner, snap ring 77, at surface 77A, conductively engages metalized surface 88. In addition, at surface 77B, the snap ring conductively engages the upper surface 42 of MCP 16. The snap ring also secures and locks down the MCP into a fixed position within the housing.

The above described method of securing the MCP with the snap ring results in some drawbacks. One drawback is the extra effort required to compress the snap ring with pliers, and properly release the compression after the snap ring is placed on top of the MCP. Another drawback is the possibility of cracking the MCP, when the compression of the snap ring is unevenly released. The present invention, as will be explained, provides a solution to these drawbacks.

SUMMARY OF THE INVENTION

To meet this and other needs, and in view of its purposes, the present invention provides an image intensifier tube including a multichannel plate (MCP) having conductive input and output surfaces disposed in a housing. A conductive lower support is in electrical contact with the output surface of the MCP, and a conductive upper support is disposed above the input surface of the MCP. A shape memory alloy (SMA) lockdown is disposed between the input surface of the MCP and the upper support. The SMA lockdown is configured to provide a lockdown for the MCP in the housing.

The SMA lockdown includes an SMA upper surface and an SMA lower surface. The SMA upper surface is configured to provide an axial force against the upper support, and the SMA lower surface is in contact with the input surface of the MCP.

The SMA upper surface may include a chamfer at a peripheral portion of the SMA lockdown, so that the chamfer provides the axial force against the upper support.

The SMA lockdown includes a memorized state and a deformed state, where the SMA lockdown has a larger diameter in the memorized state than in the deformed state. The SMA is configured to provide the axial force against the upper support in the memorized state. On the other hand, the SMA is configured free-of the axial force against the upper support in the deformed state.

The SMA upper surface, the upper support and the input surface of the MCP are in electrical contact with each other.

The SMA upper surface may be circular including a diameter of $D_1$, and the SMA lower surface may be circular including a larger diameter of $D_2$. The upper support may be circular including an inner aperture. The diameter $D_2$ is then smaller than the inner aperture for inserting the SMA lockdown through the inner aperture and disposing the SMA lower surface on top of the MCP.

In another embodiment, the present invention includes an image intensifier tube having a lower support and an upper support in a housing. A multichannel plate (MCP) is disposed on top of the lower support; a shape memory alloy (SMA) element is disposed on top of the MCP; and the upper support is disposed above the SMA element. The SMA element is configured for locking down the MCP between the lower support and the upper support.

The SMA element includes a deformed state and a memorized state. The SMA element is configured for locking down the MCP in the memorized state, and configured for insertion between the MCP and the upper support in the deformed state.

The SMA element has a larger diameter in the memorized state than it does in the deformed state. The SMA element, the MCP and the upper support are in electrical contact with each other in the memorized state. The SMA element includes a peripheral portion facing another portion of the upper support, and the peripheral portion of the SMA element is configured to provide an axial force against the other portion of the upper support in the memorized state.

The SMA element includes an SMA upper surface and an SMA lower surface. The SMA upper surface is circular including a diameter of $D_1$; the SMA lower surface is circular including a larger diameter of $D_2$; and the upper support is circular including an inner aperture. The diameter $D_2$ is smaller than the inner aperture for inserting the SMA element through the inner aperture and disposing the SMA lower surface on top of the MCP. The diameters $D_1$ and $D_2$ are of a first relative size in the deformed state for disposing the SMA element on top of the MCP. Furthermore, the diameters $D_1$ and $D_2$ are of a second relative size in the memorized state for locking down the MCP. The first relative size is smaller than the second relative size.

In still another embodiment of the present invention an image intensifier tube includes a lower support and an upper support in a housing, and a shape memory alloy (SMA) element disposed on top of the lower support. A multichannel plate (MCP) is disposed on top of the SMA element, and the upper support is disposed above the MCP. The SMA element is configured for locking down the MCP between the lower support and the upper support.

The SMA element includes a deformed state and a memorized state. The SMA element is configured for locking down the MCP in the memorized state, and is configured for insertion on top of the lower support in the deformed state. The SMA element includes a larger diameter in the memorized state than in the deformed state. The SMA element, the MCP and the lower support are in electrical contact with each other in the memorized state. The SMA element includes a peripheral portion facing another portion of the lower support, and the peripheral portion of the SMA element is configured to provide an axial force against the other portion of the lower support in the memorized state.

The SMA element includes an SMA upper surface and an SMA lower surface. The SMA upper surface is circular including a diameter of $D_1$; the SMA lower surface is circular including a larger diameter of $D_2$; and the upper support is circular including an inner aperture. The diameter $D_2$ is smaller than the inner aperture for inserting the SMA element through the inner aperture and disposing the SMA lower surface on top of the lower support.

It is understood that the foregoing general description and the following detailed description are exemplary, but are not restrictive, of the invention.

BRIEF DESCRIPTION OF THE FIGURES

The invention may be understood from the following detailed description when read in connection with the accompanying figures.

DETAILED DESCRIPTION OF THE INVENTION

The Gen 2 and 3 image intensifier ($I^2$) tubes contain microchannel plates (MCPs) for electron amplification. The MCP is a thin glass disk, and must be held in place in the $I^2$ tube securely and in precise location. Typically, the MCP is placed on an annular ledge called the lower support, and is fixed in place with a locking element. Current MCP fixing methods use a tab lockdown, or a snap ring lockdown. The snap ring was described earlier by reference to FIGS. 1-4.

The tab lockdown will now be briefly described. The tab lockdown includes a wavy washer, or equivalent, which is placed over the rim of the MCP. Next, a notched annular plate is placed over the wavy washer. The notches of the annular plate pass over tabs in the MCP upper support, and press against the wavy washer to preload it. With the plate in position, the upper support tabs are bent over, thereby, securing both the annular plate and wavy washer against the MCP.

Figure 1:
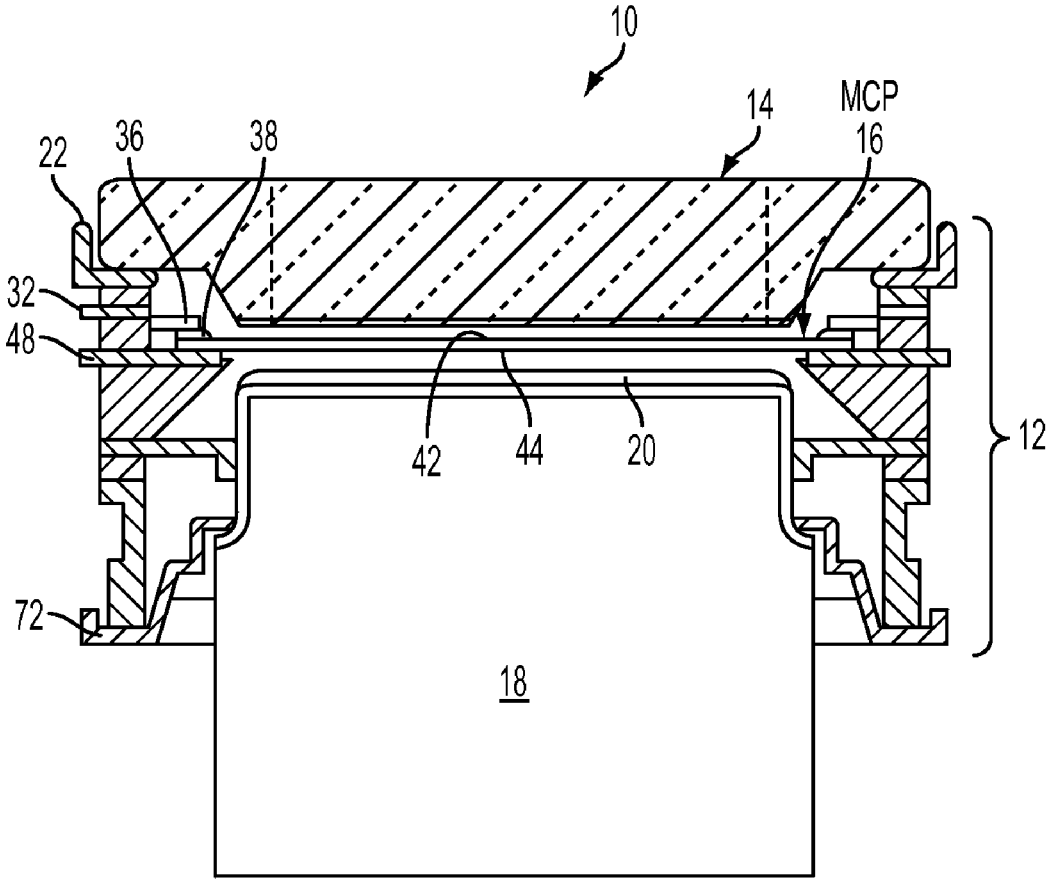
FIG. 1 PRIOR ART
FIG. 1 is a cross-sectional view of a conventional image intensifier tube.
Figure 2:
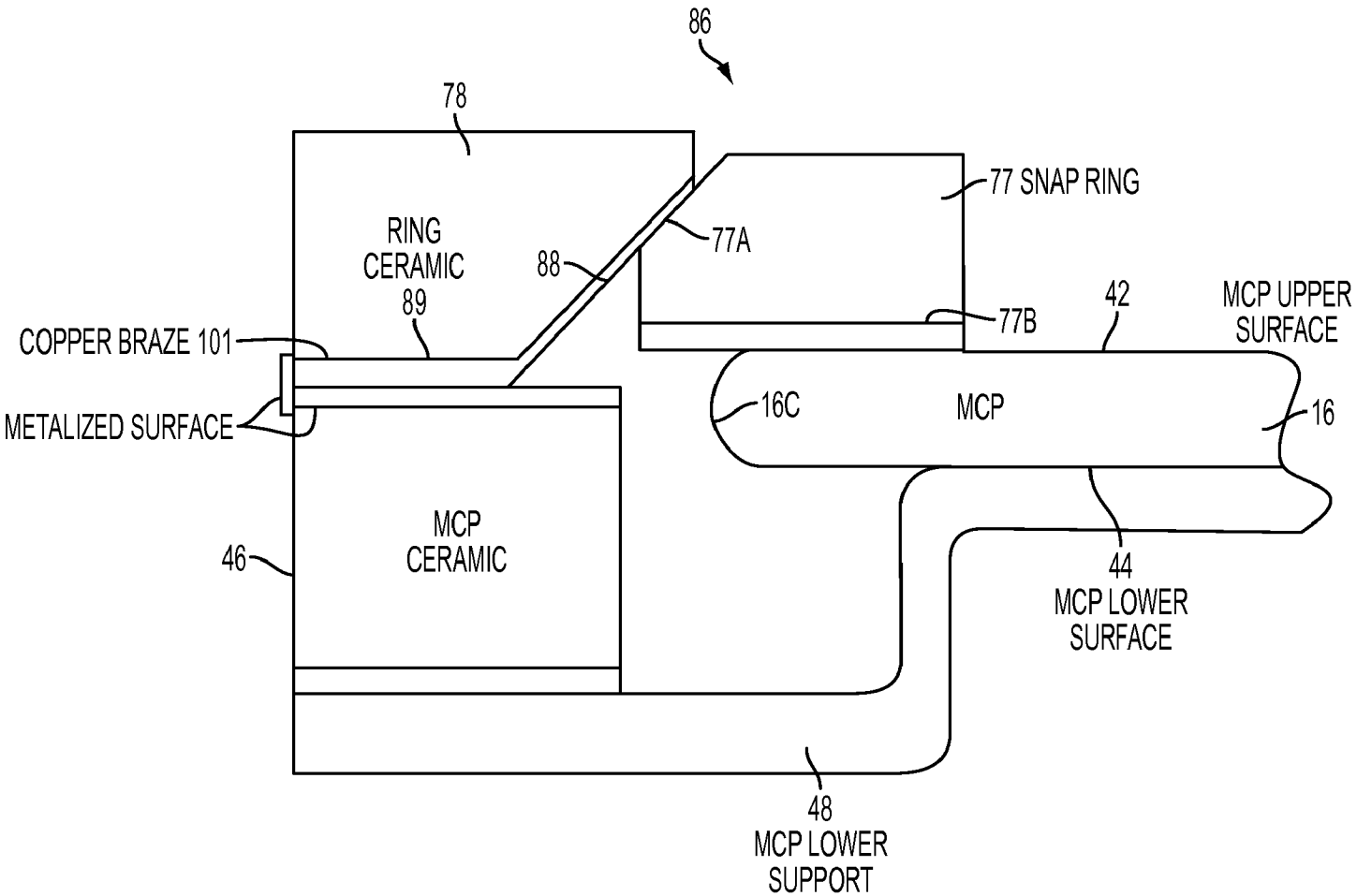
FIG. 2 PRIOR ART
FIG. 2 is a cross-sectional view of a conventional snap ring assembly inserted in the image intensifier tube of FIG. 1.
Figure 3:
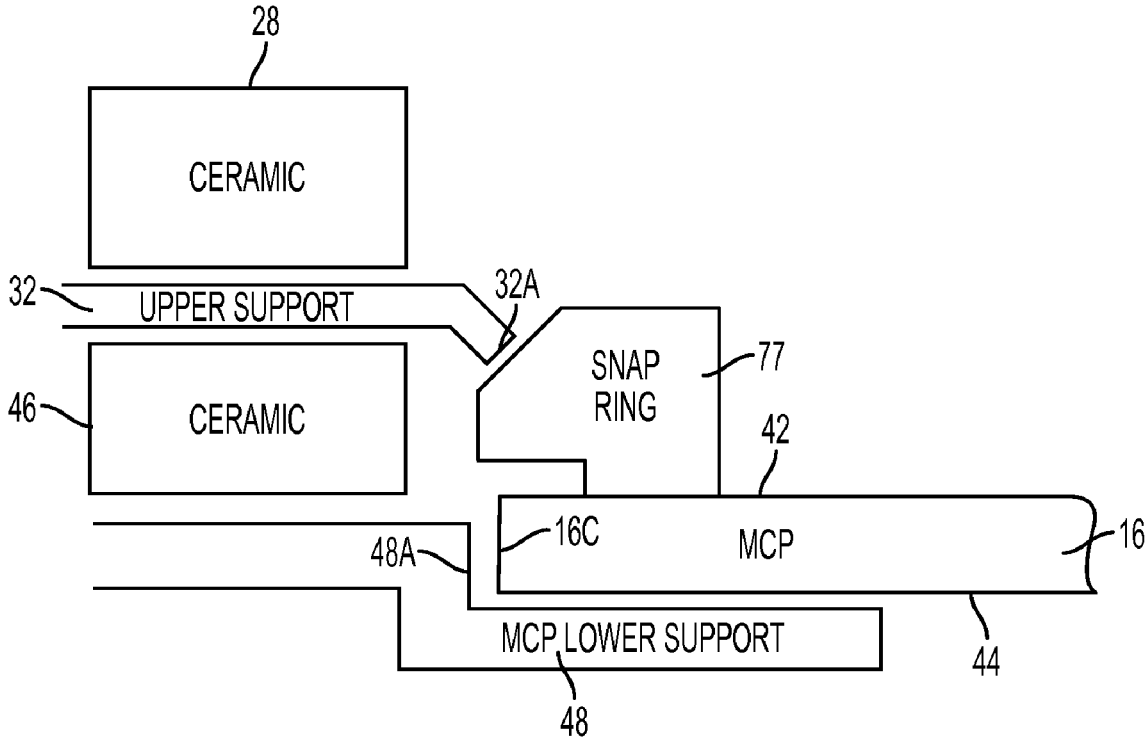
FIG. 3 PRIOR ART
FIG. 3 is cross-sectional view of another conventional snap ring assembly inserted in the image intensifier tube of FIG. 1.
Figure 4:
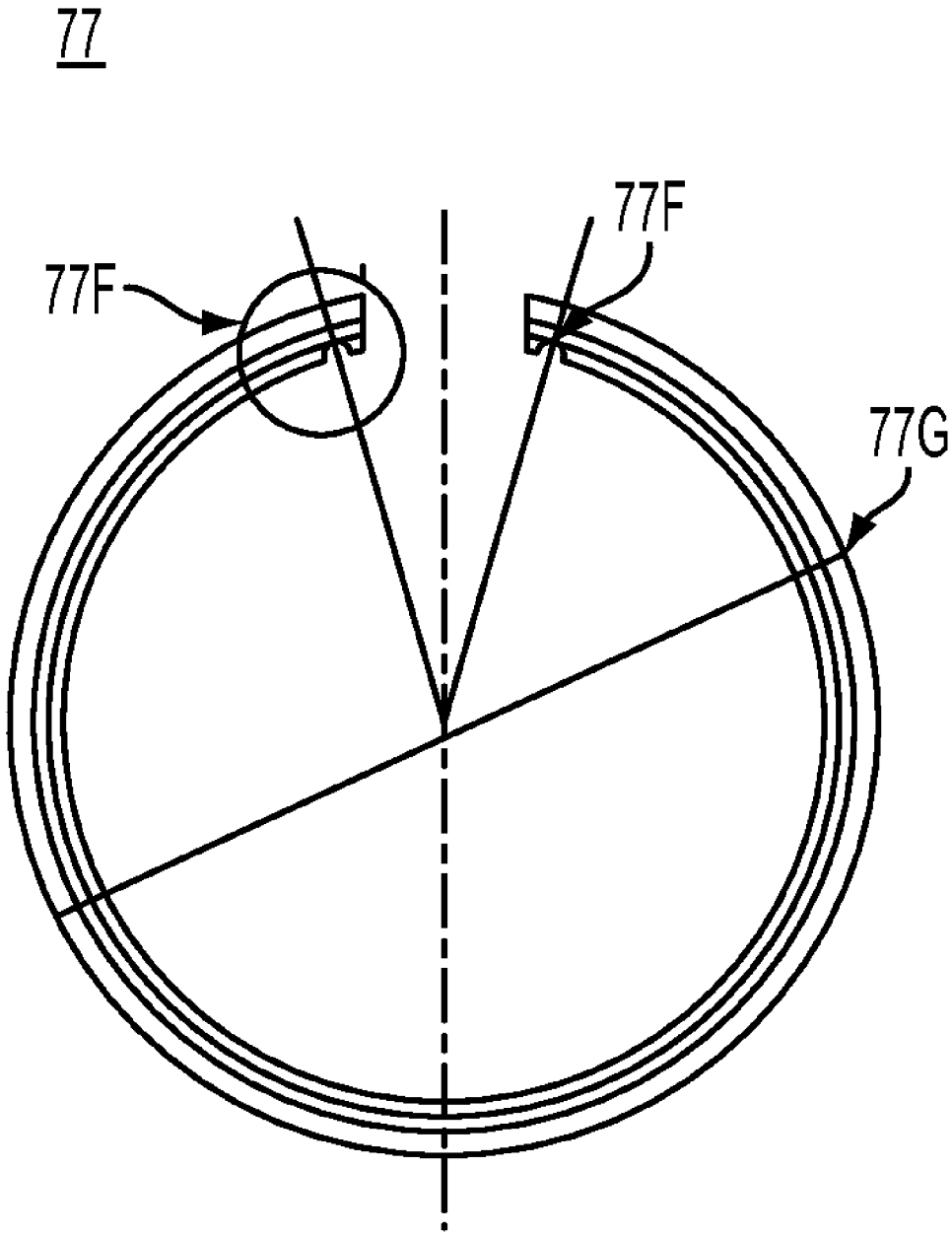
FIG. 4 PRIOR ART
FIG. 4 is a top view of a conventional snap ring used in the image intensifier tube of FIG. 1.

The snap ring lockdown, as previously described, includes a specially made snap ring (FIG. 4). After MCP insertion into the housing, the specially made snap ring with a beveled edge is compressed with pliers and inserted through the upper support and released. As the pliers are released, the snap ring expands, and the beveled edge of the snap ring and the upper support engage each other. The beveled edge translates the radial expansion force of the snap ring into an axial thrust force against the MCP.

The inventors discovered that both, the tab lockdown and the snap ring lockdown, have notable drawbacks. During operation, an image intensifier is subject to considerable shock and vibration. In addition, the MCP must be held very rigidly to prevent deformation. Modern gated power supplies also create high frequency voltage pulses that may cause the MCP to flex due to coulombic attraction. If the MCP is not secured all around its circumference, an audible tone may be produced. The MCP also has an extremely thin ion barrier film on its exposed face that may be damaged by the slightest touch.

The tabbed lockdown requires two elements to be placed over the MCP, each with a chance of contacting the ion barrier film over the active area of the MCP. This contact may cause film damage that cannot be detected until the tube is sealed and operating.

Furthermore, the tab bending operation is an additional opportunity for MCP damage, if the tool slips. Furthermore, the wavy washer may not adequately spread the lockdown force around the MCP. The unsupported areas may be free to flex, creating audibility and shock problems. The need to compress the wavy washer by hand, while bending the tabs, also limits the amount of axial thrust that the tab lockdown method may produce, resulting in reduced MCP rigidity.

The inventors also discovered that while the snap ring lockdown may overcome some of the problems of the tab lockdown, the snap ring lockdown has produced a few new problems. The snap ring provides an even force distribution, but occasionally binds, resulting in a portion of the MCP being left unsupported. The snap ring must be compressed with pliers during insertion, but insufficient dexterity or visibility results in hitting the MCP active area. The MCP may also crack under the lugs of the snap ring. In addition, the snap ring has a complicated shape, and is difficult and expensive to manufacture.

The present invention provides a new locking element, or pressure element for MCP lockdown in the image intensifier housing. As will now be explained, the new locking element eliminates problems associated with the tab lockdown element and the snap ring lockdown element.

Figure 5:
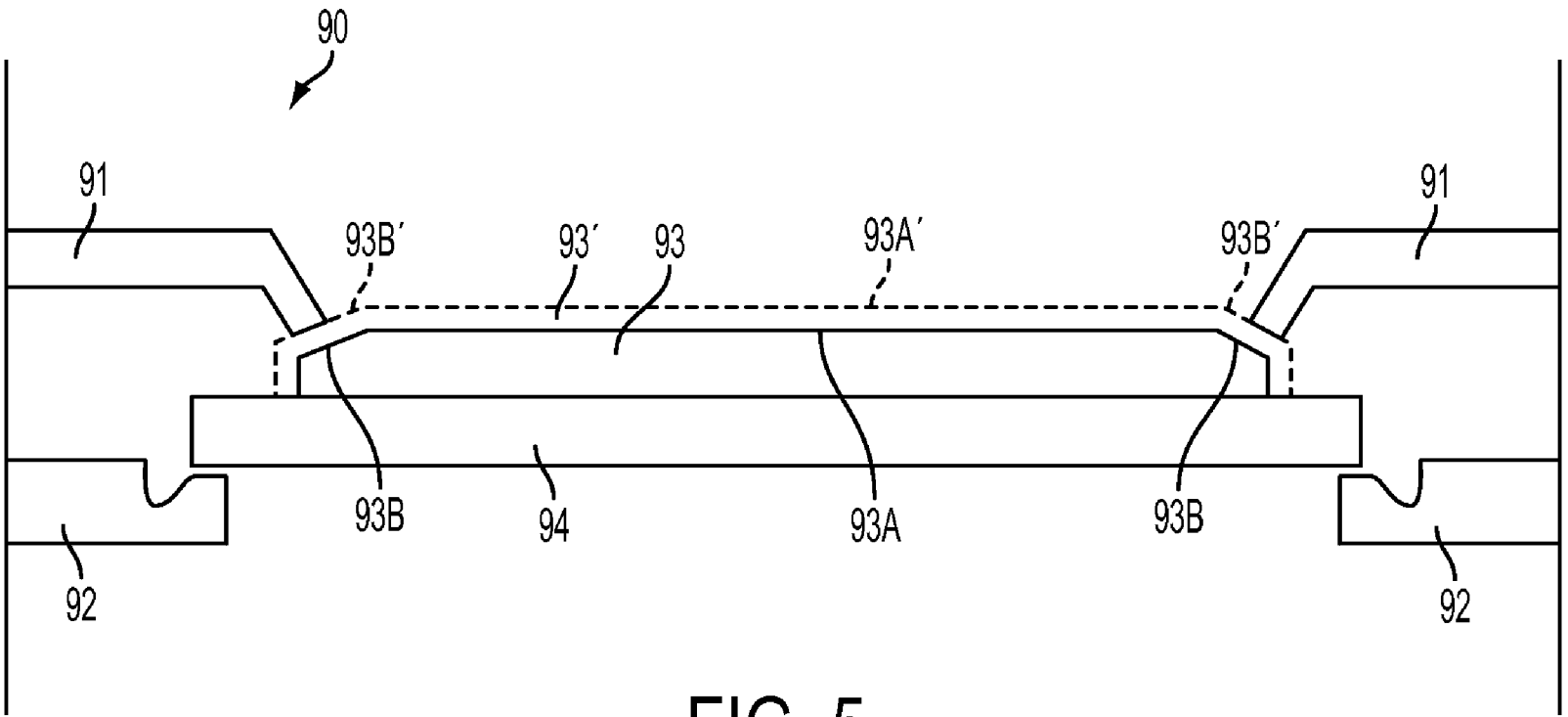
FIG. 5 is an example of a shape memory alloy (SMA) lockdown disposed between an upper support and a lower support of an image intensifier tube, in accordance with an embodiment of the present invention.
Figure 6:
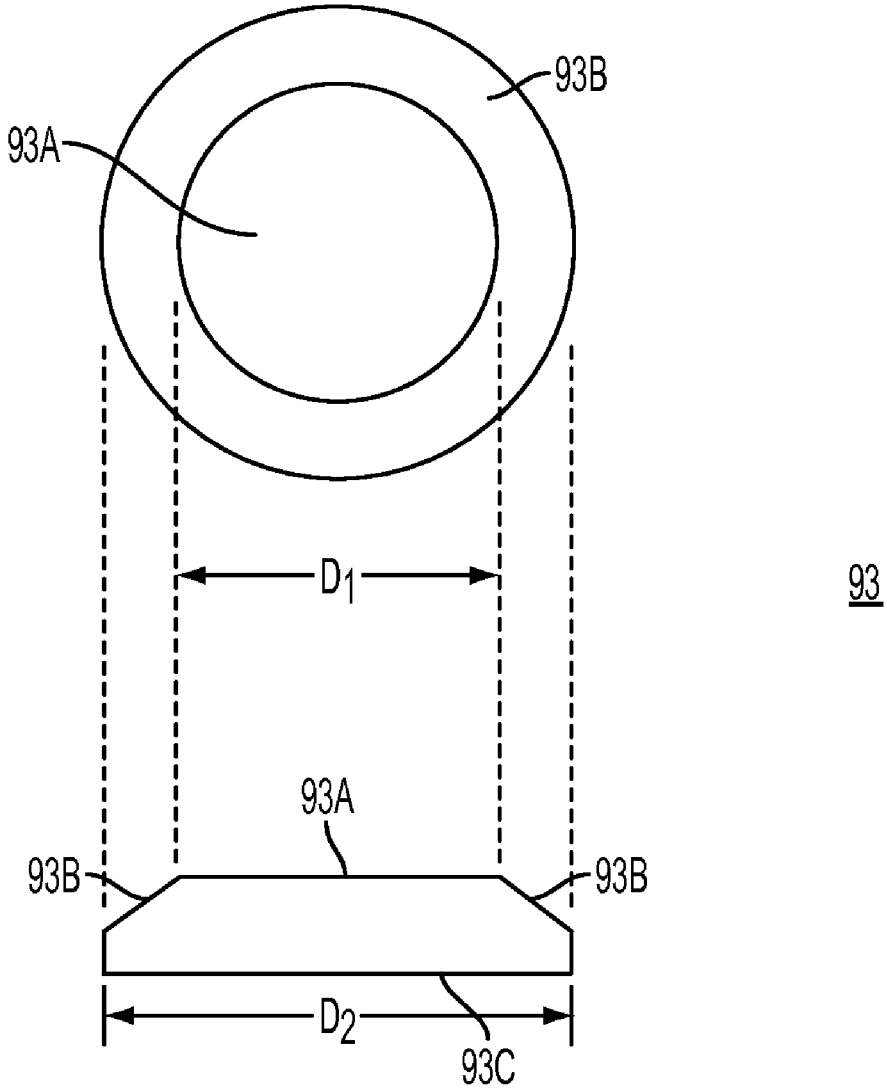
FIG. 6 are top and front views of the exemplary SMA lockdown shown in FIG. 5, in accordance with an embodiment of the present invention.

Referring now to FIGS. 5 and 6, there is shown an example of an element for MCP lockdown fabricated from shape memory alloys (SMAs). In the example shown in FIG. 6, SMA lockdown 93 includes a lower surface 93C and an opposing upper surface 93A. The upper surface has a circular shape of diameter $D_1$; and the lower surface has a circular shape with a larger diameter $D_2$. An end portion of lower surface 93C extends upwardly a first distance (not labeled) and then bends inwardly to meet the end portion of upper surface 93A. In this manner, chamfer 93B is formed.

The exemplary SMA lockdown 93 may be inserted in an image intensifier ($I^2$) housing, designated as 90, and placed on top of MCP 94, as shown in FIG. 5. This may be accomplished without any force. During assembly, MCP 94 may be placed on top of lower support 92 (shown as an example). Next, SMA lockdown 93 may be placed on top of MCP 94. Since the SMA lockdown, in its deformed state (as explained below), has a reduced diameter ($D_1$ and $D_2$), as compared to snap ring 77 (FIGS. 3 and 4), the SMA lockdown may easily be placed on top of MCP 94 after being inserted through the aperture of upper support 91.

In the example shown in FIG. 5, in its deformed state (or pre-use state), the SMA lockdown 93 has a smaller diameter (shown in cross-section as top surface 93A terminating in chamfer 93B) than a diameter of the same SMA lockdown 93 in its memorized state (or normal-use state) (shown in cross-section as top surface 93A terminating in chamfer 93B'). In its memorized state, after being heated, SMA lockdown 93 expands to provide a clamping force against the MCP and an axial force against upper support 91. In this manner, after transitioning into its memorized state, the SMA lockdown 93 provides a lock down mechanism for the MCP and fixes the MCP in place.

As described above, the shaped memory element requires no force to install. The SMA lockdown element is shaped so that it is easily emplaced, and readily adaptable for automatic insertion. Only after insertion, and only after being heated, does the SMA lockdown element change shape to provide a clamping force to the MCP.

Unlike the snap ring lockdown which has gaps in its structure, the shaped memory ring may be continuous without any gap that may lead to cesium migration problems. The reduced diameter needed to clear the upper support may be produced by deformation of the SMA lockdown, which may then be recovered to its larger memorized state after being heated.

Because the SMA lockdown element is continuous and radially symmetric, it may be fabricated at low cost by stamping, or lathe turning without secondary machining.

The SMA lockdown 93 is fabricated from shape memory alloys. These alloys may include nickel-titanium-based alloys, which attempt to return to a preset shape when heated. If the shape recovery is hindered, considerable stress is developed within the alloy.

Shape memory alloys have a heat-treated set memory shape. After heat treatment, the element is generally soft and easily deformed, and stays in a deformed shape, or deformed state. If the deformed element is then heated above a recovery temperature, the SMA element changes crystal structure, and attempts to return to the original shape set during heat treatment, or its memorized state. If the recovery is constrained, the SMA element exerts a force on the constraint that is dependent on the geometry of the element, the temperature and the amount of deformation that the element has endured.

In general, a shape memory alloy (SMA) is an alloy that "remembers" its original, cold, forged shape, and which returns to that shape after being deformed by applying heat. In addition to nickel-titanium (Ni—Ti) alloys, SMAs may include Ag—Cd alloys, Cu—Al—Ni alloys, Cu—Sn alloys, Cu—Zn alloys, Cu—Zn—Si alloys, Cu—Zn—Al alloys, In—Ti alloys, Ni—Al alloys, Fe—Pt alloys, Mn—Cu alloys, Fe—Mn—Si alloys, and the like. Currently, Ni—Ti alloys (also known as Nitinol) are considered a good SMA element. Generally, these SMA elements may be plastically deformed at a predefined temperature, and upon exposure to thermal manipulation, return to a preset memorized state. Some SMA alloys are considered to be one-way shaped memory alloys, and other SMA alloys are considered to be two-way shaped memory alloys.

In a one-way shaped memory alloy, when in its cold state, the alloy can be bent or stretched and will hold those shapes until heated above the transition temperature. Upon heating, the shape changes to its original memorized shape. When the alloy cools again, it remains in the memorized shape, until deliberately deformed again. In a two-way shaped memory alloy, the alloy remembers two different shapes: one at low temperature and another at high temperature.

In the present invention, a one-way shaped memory alloy is likely preferable over the two-way shaped memory alloy. The alloy may thus be fabricated into a memorized state (such as the larger diameter of SMA lockdown 93 shown in FIG. 5). After heat treatment, the SMA lockdown is generally soft and may be easily deformed, and will stay in its deformed state (such as the smaller diameter of SMA lockdown 93 also shown in FIG. 5).

If the deformed SMA lockdown 93 is heated above the recovery temperature, the SMA lockdown changes crystal structure and returns to its original, memorized shape. The larger diameter of the SMA lockdown then stays in its memorized state and effectively provides a lock down for the MCP in its $I^2$ housing.

Figure 7:
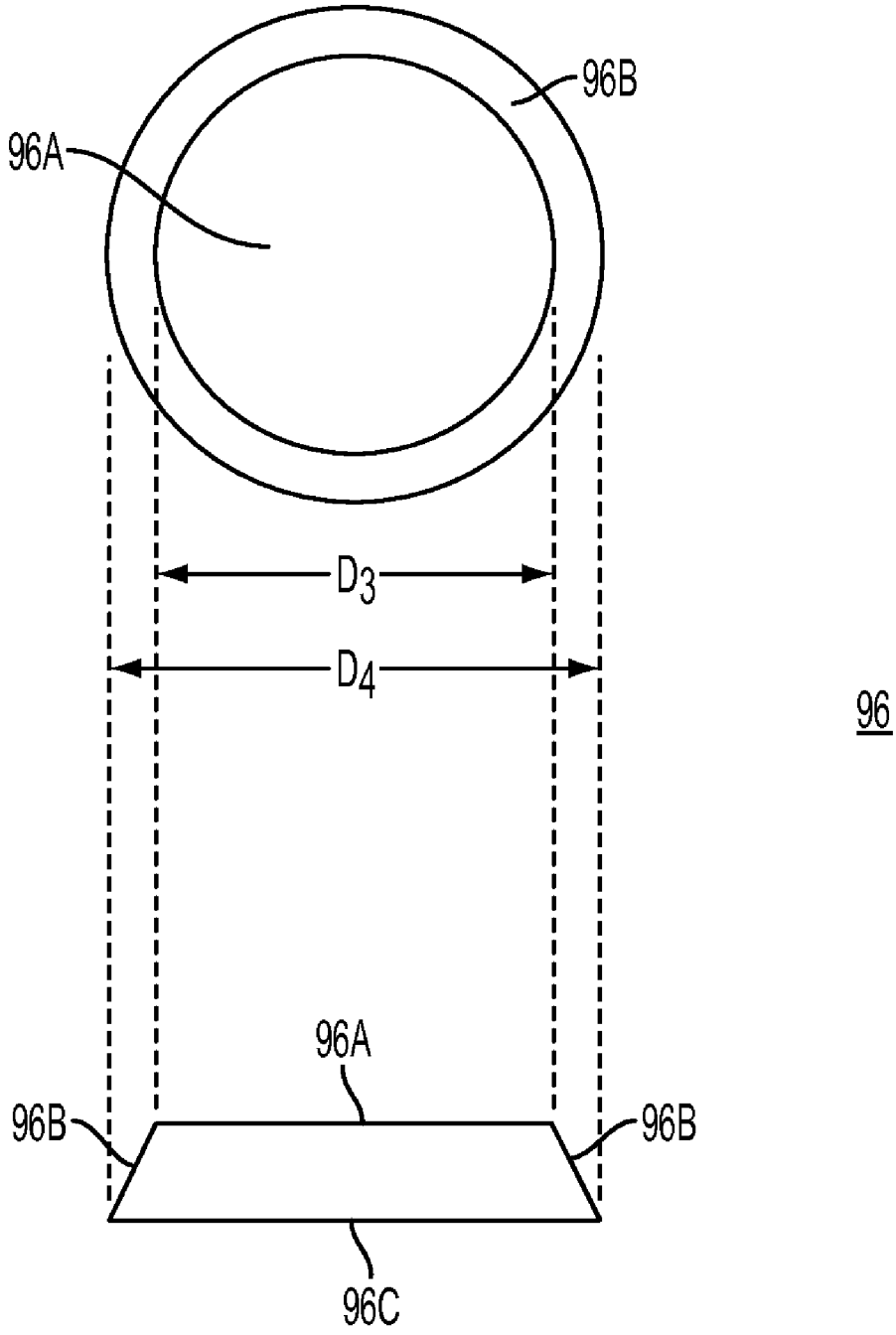
FIG. 7 is another embodiment of an SMA lockdown for insertion into the housing of an image intensifier tube, in accordance with an embodiment of the present invention.

FIG. 6 showed one example of an SMA lockdown. FIG. 7 shows another example. As shown, SMA lockdown 96 includes upper surface 96A and lower surface 96C, which are joined by a tapered surface 96B. The upper surface has an inner diameter $D_3$ and the bottom surface an outer diameter $D_4$. As long as the deformed state shown in FIG. 7 has an outer diameter $D_4$ which is smaller than the inner diameter (not labeled) of the aperture of upper support 91 (FIG. 5), SMA lockdown 96 may be easily inserted into housing 90, passed through the aperture of the upper support, and then placed on top of MCP 94. This may be accomplished without any specialized tools, and without any force. The tapered surface 96B may be formed so that it is parallel to the inner end portion of upper support 91.

After heat treatment, above its recovery temperature, SMA lockdown 96 changes crystal structure and returns to its memorized state, which may be similar to the deformed state shown in FIG. 7, except that SMA lockdown 96 is now expanded and includes larger diameters $D_3$ and $D_4$, as compared to the diameters of its deformed state. The SMA lockdown stays in its memorized state and effectively provides a lock down for the MCP in the $I^2$ housing.

Many other configurations and shapes of an SMA lockdown, of course, are possible and are contemplated within the scope of the present invention. The only limitations for the SMA lockdown are that the SMA lockdown have a deformed state that allows easy insertion into the $I^2$ housing and easy placement on top of the MCP. In addition, the SMA lockdown requires a surface that provides axial pressure against the upper support, when the SMA lockdown is in its larger memorized state.

One possible configuration for an SMA lockdown includes a replacement element for the present snap ring. Such an SMA lockdown includes a shape which fits within the same volume of the present snap ring in the housing; no alteration is required to other $I^2$ tube components in the housing. Such a ring may include a circular cross section with one beveled corner. When deformed into a smaller diameter (either concentrically, or by 3 or more "puckers"), the ring fits easily between the MCP and the upper support. After being heated, the ring expands to fill the space between the MCP and the upper support. The final shape may be round, with a diameter large enough to interact with the upper support and produce an axial thrust force against the upper support.

In another embodiment, the SMA lockdown may include a folded sheet metal which unfolds to contact the upper support. Friction or galling between the SMA lockdown and the upper support may cause the thrust force distribution to be less uniform, but is still likely to be better than the present snap ring.

In yet another embodiment, the SMA lockdown may be a separate pressure plate consisting of a convoluted washer placed above or below the MCP. The washer would be pressed flat prior to insertion, and would recover to the convoluted shape which would apply force to the MCP. This embodiment may require a separate part to transmit the thrust force to the body, but this embodiment would have an advantage of distributing pressure more uniformly.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An image intensifier tube comprising:

a microchannel plate (MCP) having conductive input and output surfaces disposed in a housing, a conductive lower support in electrical contact with the output surface of the MCP, a conductive upper support disposed above the input surface of the MCP, and a shape memory alloy (SMA) lockdown disposed between the input surface of the MCP and the upper support, wherein the SMA lockdown is configured to provide a lockdown for the MCP in the housing.

2. The image intensifier tube of claim 1 wherein the SMA lockdown includes an SMA upper surface and an SMA lower surface, the SMA upper surface is configured to provide an axial force against the upper support, and the SMA lower surface is in contact with the input surface of the MCP.

3. The image intensifier tube of claim 2 wherein the SMA upper surface includes a chamfer at a peripheral portion of the SMA lockdown, and the chamfer provides the axial force against the upper support.

4. The image intensifier tube of claim 2 wherein the SMA lockdown includes a memorized state and a deformed state, the SMA lockdown having a larger diameter in the memorized state than in the deformed state, and SMA upper surface provides the axial force against the upper support in the memorized state.

5. The image intensifier tube of claim 2 wherein the SMA lockdown includes a memorized state and a deformed state, the SMA lockdown having a larger diameter in the memorized state than in the deformed state, and the SMA upper surface is configured free-of the axial force against the upper support in the deformed state.

6. The image intensifier tube of claim 2 wherein the SMA upper surface, the upper support and the input surface of the MCP are in electrical contact with each other.

7. The image intensifier tube of claim 2 wherein the SMA upper surface is circular including a diameter of $D_1$, the SMA lower surface is circular including a larger diameter of $D_2$, the upper support is circular including an inner aperture, and the diameter $D_2$ is smaller than the inner aperture for inserting the SMA lockdown through the inner aperture and disposing the SMA lower surface on top of the MCP.

8. An image intensifier tube comprising:

a lower support and an upper support in a housing, a multichannel plate (MCP) disposed on top of the lower support, a shape memory alloy (SMA) element disposed on top of the MCP, and the upper support disposed above the SMA element, wherein the SMA element is configured for locking down the MCP between the lower support and the upper support.

9. The image intensifier tube of claim 8 wherein the SMA element includes a deformed state and a memorized state, the SMA element is configured for locking down the MCP in the memorized state, and the SMA element is configured for insertion between the MCP and the upper support in the deformed state.

10. The image intensifier tube of claim 9 wherein the SMA element includes a larger diameter in the memorized state than in the deformed state.

11. The image intensifier tube of claim 9 wherein the SMA element, the MCP and the upper support are in electrical contact with each other in the memorized state.

12. The image intensifier tube of claim 9 wherein the SMA element includes a peripheral portion facing another portion of the upper support, and the peripheral portion of the SMA element is configured to provide an axial force against the other portion of the upper support in the memorized state.

13. The image intensifier tube of claim 9 wherein the SMA element includes an SMA upper surface and an SMA lower surface, the SMA upper surface is circular including a diameter of $D_1$, the SMA lower surface is circular including a larger diameter of $D_2$, the upper support is circular including an inner aperture, and the diameter $D_2$ is smaller than the inner aperture for inserting the SMA element through the inner aperture and disposing the SMA lower surface on top of the MCP.

14. The image intensifier tube of claim 13 wherein the diameters $D_1$ and $D_2$ are of a first relative size in the deformed state for disposing the SMA element on top of the MCP, the diameters $D_1$ and $D_2$ are of a second relative size in the memorized state for locking down the MCP, and the first relative size is smaller than the second relative size.

15. An image intensifier tube comprising:

a lower support and an upper support in a housing, a shape memory alloy (SMA) element disposed on top of the lower support, a multichannel plate (MCP) disposed on top of the SMA element, and the upper support disposed above the MCP, wherein the SMA element is configured for locking down the MCP between the lower support and the upper support.

16. The image intensifier tube of claim 15 wherein the SMA element includes a deformed state and a memorized state, the SMA element is configured for locking down the MCP in the memorized state, and the SMA element is configured for insertion on top of the lower support in the deformed state.

17. The image intensifier tube of claim 16 wherein the SMA element includes a larger diameter in the memorized state than in the deformed state.

18. The image intensifier tube of claim 16 wherein the SMA element, the MCP and the lower support are in electrical contact with each other in the memorized state.

19. The image intensifier tube of claim 16 wherein the SMA element includes a peripheral portion facing another portion of the lower support, and the peripheral portion of the SMA element is configured to provide an axial force against the other portion of the lower support in the memorized state.

20. The image intensifier tube of claim 16 wherein the SMA element includes an SMA upper surface and an SMA lower surface, the SMA upper surface is circular including a diameter of $D_1$, the SMA lower surface is circular including a larger diameter of $D_2$, the upper support is circular including an inner aperture, and the diameter $D_2$ is smaller than the inner aperture for inserting the SMA element through the inner aperture and disposing the SMA lower surface on top of the lower support.

* * * * *